US006506033B2

(12) United States Patent
Fukami

(10) Patent No.: US 6,506,033 B2
(45) Date of Patent: Jan. 14, 2003

(54) MINIATURE PUMP WITH BALL-PLATE DRIVE

(75) Inventor: Tadashi Fukami, Inagi (JP)

(73) Assignee: Okenseiko Co., Ltd., Tokyo (JP)

( * ) Notice: Subject to any disclaimer, the term of this patent is extended or adjusted under 35 U.S.C. 154(b) by 16 days.

(21) Appl. No.: 09/867,417

(22) Filed: May 31, 2001

(65) Prior Publication Data

US 2002/0051717 A1 May 2, 2002

(30) Foreign Application Priority Data

Oct. 26, 2000 (JP) ..... 2000-326645
Nov. 22, 2000 (JP) ..... 2000-355803

(51) Int. Cl.[7] ..... F04B 17/00
(52) U.S. Cl. ..... 417/420; 417/93; 417/470
(58) Field of Search ..... 417/93, 96, 97, 417/98, 413.1, 420, 470, 269, 415; 74/57; 92/71

(56) References Cited

U.S. PATENT DOCUMENTS 2,913,911 A * 11/1959 Gilkey ..... 74/60
3,299,819 A * 1/1967 McCoy ..... 417/420
6,142,060 A * 11/2000 Saito et al. ..... 417/269
6,206,664 B1 * 3/2001 Kakizawa ..... 417/569
6,264,438 B1 * 7/2001 Fukami ..... 417/412

FOREIGN PATENT DOCUMENTS

JP 62291484 A 12/1987
JP 11230046 A 8/1999

* cited by examiner

*Primary Examiner*—Charles G. Freay
*Assistant Examiner*—John F Belena
(74) *Attorney, Agent, or Firm*—Pillsbury Winthrop LLP

(57) ABSTRACT

A miniature pump equipped with: a pump chamber communicated with a suction port by way of a check valve and communicated with a discharge port by way of another check valve; a driving portion for performing a pump function by increasing and decreasing a volume of the above described pump chamber; a driving plate attached to the above described driving portion for reciprocating the driving portion; a rotating plate fixed to an output shaft of a motor; a ball disposed at a location which is between the above described driving member and the above described rotating plate, and apart from the above described output shaft; and means for applying a force to a surface of the above described driving plate on a side of the above described rotating plate for bringing the above described driving plate into close contact with the above described ball, in which an inclined direction of the above described driving plate is continuously changed by a movement caused due to rotations and revolutions of the above described ball as the above described rotating plate rotates, thereby reciprocating the above described driving portion and performing a pump function.

9 Claims, 11 Drawing Sheets

MINIATURE PUMP WITH BALL-PLATE DRIVE

BACKGROUND OF THE INVENTION a) Field of the Invention

The present invention relates to a miniature pump.

b) Description of the Prior Art

Out of conventional miniature pumps, a pump disclosed by Japanese Patent Kokai Publication No. Sho 62-291484 is known as a miniature pump which uses a diaphragm and has a configuration schematically shown in FIG. 1.

This conventional miniature pump uses a disk like driving plate 5 fitted over a driving shaft 4 which is fitted into a crank stand 3 fixed to an output shaft 2 of a motor 1 as shown in FIG. 1. Disposed around an outer circumferential portion of this disk like driving plate is a singularity or a plurality of cup diaphragm members 6 which have upward openings. In case of a pump in which the plurality of diaphragm members 6 are disposed, the diaphragm members are arranged at equal intervals on a circumference. Furthermore, a reference numeral 7 represents a cylindrical valve, a reference numeral 8 designates another valve, a reference numeral 9 denotes a suction port and a reference numeral 10 represents a discharge port.

The a miniature pump drives the motor 1 to rotate its output shaft 2, which rotates the crank stand 3 and causes a dish-turning-gyrating movement of the driving plate 5 by way of the driving shaft 4, thereby moving up and down driving portions 6*a* at roots of the diagram members 6. Accordingly, the root portion (driving portion) 6*a* of the cup like diaphragm member 6 which is located to a left side, for example, in FIG. 1 moves to go up from a lowered condition and the root portion (driving portion) 6*a* of the diaphragm member 6 which is located on a right side moves to go down from a raised condition.

By the up-down movements of the root portions of the diaphragm members 6, the diaphragm members allow a fluid to be sucked and discharged at intervals of a definite time, thereby performing a pump function.

In order to ideally reciprocate the diaphragm members 6, the above described conventional miniature pump must be configured so as to align a center G of the diaphragms 6 of the driving plate 5 with a fixed center of the output shaft. That is, the center G must be located on a prolonged line of the output shaft 2. For this reason, the driving shaft requires a bearing and the driving plate 5 is prolonged, thereby enlarging the pump as a whole.

Furthermore, since the driving portion of the diaphragm member performs a reciprocal movement per rotation of the output shaft 2, the diaphragm member 6 is abnormally deformed and a service life of the diaphragm member is extremely shortened when a rotational frequency of the motor is enhanced, that is, when the output shaft is rotated at a higher speed. A motor which is large and has strong power is therefore required.

Another conventional miniature pump is a centrifugal pump (impeller pump). This conventional centrifugal pump has a configuration, for example, shown in FIG. 2. In FIG. 2, a reference numeral 21 represents a pump chamber side case, a reference numeral 22 designates a driving side case, a reference numeral 23 denotes a partition wall for partitioning a pump chamber 24 from a driving section 25, a reference numeral 26 represents an O ring, a reference numeral 27 designates an output shaft of a motor 28, a reference numeral 29 denotes a driving side yoke plate, a reference numeral 30 represents a driving side magnet fixed to the yoke plate 29, a reference numeral 31 designates a spherical bearing, a reference numeral 32 denotes a holding section for a pump chamber side magnet and the like, a reference numeral 33 represents a pump chamber side magnet, a reference numeral 33*a* designates a pump chamber side yoke plate, a reference numeral 34 denotes a cover body, a reference numeral 35 represents an impeller, a reference numeral 39 designates a fluid inlet port and a reference numeral 40 denotes a fluid outlet port.

This centrifugal pump (impeller pump) drives the motor 28 to rotate the output shaft 27, which rotates the driving side magnet 30 so that the pump chamber side magnet 33 is rotated by magnetic coupling and the impeller 35 is rotated together with the pump chamber side magnet, thereby performing a pump function.

This conventional pump is used as a pump for supplying a liquid, but has defects that the pump cannot enhance a pressure or must be configured large for obtaining a high pressure and that the pump has a low efficiency. Furthermore, the pump has defects that it has a weak force to such a liquid, whereby the pump requires priming water or must be installed lower than a level of a liquid to be sucked at a start time.

Furthermore, a pump which has a configuration shown in FIG. 3 is known as a conventional example of diaphragm pump out of miniature pumps.

In FIG. 3, a reference numeral 41 represents a motor, a reference numeral 42 designates a speed reduction mechanism which consists of a gear 43 attached to an output shaft 41*a* of the motor 41 and a gear 44 in mesh with the gear 43, a reference numeral 45 denotes a driving shaft which is fitted and fixed into and to the gear 44 so as to be eccentric from a shaft 44*a* of the gear 44, a reference numeral 46 represents a connecting rod which is rotatably coupled with the driving shaft 45, and a reference numeral 47 a diaphragm which is fixed to a tip of the connecting rod 46 and made of synthetic rubber or the like. This diaphragm 47 has a sealing member 47*a* which is disposed on its outer circumferential portion and is sandwiched between a clamp plate 48 and a casing 49, thereby sealing a pump chamber 50 from external air. Furthermore, a reference numeral 51 represents a suction port, a reference numeral 52 designates a discharge port, and check valves 53 and 54 such as leaf valves are disposed in the suction port 51 and the discharge port 52 respectively.

When the motor 41 is driven to rotate the output shaft 41*a* of the motor 41 in the diaphragm pump which has the above described configuration, the gear 44 of the speed reduction mechanism 42 is rotated and the driving shaft 45 moves the diaphragm 47 up and down by way of the connecting rod 46, whereby a volume of the pump chamber 50 is increased and decreased by the up and down movements of the diaphragm 47. The leaf valve 53 is opened and a fluid is sucked through the suction port 51 when the volume of the pump chamber 50 is increased, and the leaf valve 54 is opened and the fluid is discharged through the discharge port 52 when the volume of the pump chamber 50 is decreased, whereby the diaphragm pump performs a pump function.

Since the pump shown in FIG. 3 requires a speed reduction mechanism and a crank mechanism, the pump is complicated in a structure of a driving section for performing the pump function and is large. Furthermore, the pump produces remarkable noise during operation.

Furthermore, there is known a pump which is invented by the inventor of this invention and disclosed by Japanese Patent Kokai Publication No. Hei 11-230046. This miniature pump has a configuration shown in FIG. 4.

In FIG. 4, a reference numeral 71 represents a motor, a reference numeral 72 designates an output shaft of the motor 71, a reference numeral 73 denotes a disk like rotating plate which is fixed to the output shaft 72 and has a groove 73*a* having an arc like sectional shape and formed along a circumference around the output shaft 72 as a center. A reference numeral 75 represents a driving plate substantially like a disk, for example, and has, like the rotating plate 73, a groove 75*a* which has an arc like sectional shape and formed along a circumference around a center of the driving plate 75. A ball 74 is disposed between the groove 73*a* of the rotating plate 73 and the groove 75*a* of the driving plate 75 which are formed in opposition to each other. A reference numeral 76 represents a cylinder, a reference numeral 77 designates a diaphragm which has a driving portion 77*b* fixed to the driving plate 75 and a reference numeral 78 denotes a valve housing (cover body): a pump chamber 82 being formed by sandwiching the diaphragm 77 between the valve housing 78 and the cylinder 76, and tightening and fixing the diaphragm 77 to the cylinder portion 76 with a screw 83, thereby sealing the diaphragm 77. Though FIG. 4 shows only one pump chamber 82 which is formed in a diaphragm portion 77*c* of the diaphragm, two or more diaphragm portions 77*c* (pump chamber 82) may be formed to compose a multi-cylinder pump.

Formed integrally with the valve housing 78 are a valve chamber 79 and a discharge port 80 communicated with the valve chamber 79, and a valve 77*a* which is formed integrally with the diaphragm 77 is disposed in the valve chamber 79. Furthermore, a reference numeral 84 represents a check valve and a reference numeral 85 designates a suction port.

The pump which is described above is set so that the rotation plate 73 and the driving plate 75 are raised until a center of a top surface is brought into contact with a stopper pin 76*a* disposed at a center of the cylinder 76 and the driving plate 75 is inclined. A stroke for a reciprocal movement of the driving portion 77*b* formed integrally with the diaphragm 77 is determined by an inclination angle of the driving plate 75 and the like. Furthermore, a reference numeral 90 represents a bias spring which produces appropriate friction by loading the ball when a load on the ball is light. Therefore, this bias spring 90 may not be used when appropriate friction is applied to the ball 74 in a relation to a load.

When the output shaft 72 is driven and rotated by the motor 71 in this miniature motor, the rotating plate 73 fixed to the output shaft 72 is rotated. When the rotating plate 73 is rotated, the ball 74 which is pressed to the rotating plate 75 by the bias spring 90 and the like moves around the output shaft 72 in a direction identical to a rotating direction of the rotating plate 73 while rotating. Since the groove 73*a* of the rotating plate 73 and the groove 75*a* of the driving plate 75 which have the arc like sectional shapes have radii nearly equal to each other (the radius of the groove 75*a* of the driving plate 75 is generally a little shorter), the ball 74 moves at a speed about half a speed of the rotating plate 73, whereby the ball 74 makes nearly one turn around the output shaft 72 when the rotating plate 73 makes two turns.

Accordingly, the ball 74 makes half a turn and moves from a location on a right side of the output shaft 72 to a location on a left side of the output shaft 72 when the rotating plate 73 makes one turn from a position shown in FIG. 4, whereby the driving plate moves the driving portion 77*b* of the diaphragm 77 from an upper position to a lower position. The rotation of the rotating plate 73 causes upward and downward movements of the driving portion 77*b* as described above, thereby performing a pump function. That is, the downward movement of the driving portion 77*b* from the location shown in FIG. 4 increases a volume of the pump chamber 82 and opens the valve 84, thereby allowing a fluid to flow into the pump. When the driving portion 77*b* goes up again, the volume of the pump chamber 82 is decreased and a gas is pressurized in the pump chamber, thereby opening the valve 77*a* and allows the fluid to be discharged from the discharge port 80 through the valve chamber 79.

While repeating the movements described above, the pump performs the pump function by sucking the fluid from the suction port 85 and discharging the fluid from the discharge port 80.

When the bias spring is not used, this conventional miniature pump allows the driving plate 75 to float up during driving, thereby being incapable of sufficiently transmitting the rotation of the rotating plate 73 by way of the ball 74, reciprocating the diaphragm portion at an accurate speed or at accurate time intervals, and supplying and sucking the fluid stably. Furthermore, the conventional miniature pump may produce noise since the driving plate 85 and the ball 74 are repeatedly brought into contact and separated.

In order to correct this defect, it is conceivable to dispose the bias spring 90 as shown in the conventional example as shown in FIG. 4, thereby keeping the driving plate 75 in contact with the ball 74.

When the bias spring 90 has a weak force, this method is ineffective and allows the pump to remain unchanged from the pump in which a bias spring is not used. Furthermore, the driving plate is inclined remarkably when the bias spring 90 has a strong force. A reason is that a side of the driving plate 75 to which the force of the bias spring 90 is exerted (a left side in FIG. 4) is pushed down using the ball 74 as a fulcrum as shown in FIG. 4 and a left side of the driving plate 75 in FIG. 4 is lowered, thereby enlarging an inclination angle. As a result, the driving plate 75 is apart from a tip of the stopper pin 76*a*, whereby a variation in inclination of the driving plate 75 is unstable, and the upward and downward movements (reciprocal movements) of the diaphragm 77 is unstable. When the bias spring 90 has a force which is further too strong, the inclination angle is further enlarged and the driving plate 75 comes into contact with the rotating plate 73, thereby posing problem that the rotation of the rotating plate 73 is unstable, that noise if further produced and the like.

The pump mentioned as the conventional example shown in FIG. 4 poses the problem when a spring has a weak force or when the spring has a strong force reversely, allows a spring force to be set appropriately only within a narrow width and operates favorably only within an extremely a narrow range of spring forces. Accordingly, the pump requires extremely high precisions for parts such as the bias spring 90, the rotating plate 73, the ball 74 and the driving plate 75, thereby requiring a high manufacturing cost.

SUMMARY OF THE INVENTION

An object of the present invention is to provide a miniature pump characterized in that the pump comprises: a pump chamber which is communicated with a suction port by way of a check valve and communicated with a discharge port by way of another check valve; a driving portion which performs a pump function by increasing and decreasing a volume of this pump chamber; a driving portion which performs the a driving portion is attached and which reciprocates the driving portion, a ball which is disposed at a location between the rotating plate and the driving plate, and apart from a rotating shaft of the rotating plate; and a spring which brings the driving plate into pressure contact with the ball by applying a force from a side of the rotating plate, an inclined direction of the driving plate is continuously changed by a movement of the ball caused due to rotation and revolution of the ball, and a pump function is performed by reciprocating the driving portion due to the change of the inclined direction of the driving plate.

Another object of the present invention is to provide a miniature pump comprising: a pump chamber which is communicated with a suction port by way of a check valve and communicated with a discharge port by way of another check valve; a driving portion which increases and decreases a volume of the pump chamber; a driving plate which reciprocates the driving portion; a rotating plate which is fixed to an output shaft of a motor; a ball which is disposed between the rotating plate and the driving plate; and a cam surface which is disposed on a rotating plate side of the driving plate, wherein the ball moves while rotating and revolving due to rotations of the rotating plate, and wherein rotations of the rotating plate causes rotations and revolution of the ball which move the ball, the movement of the ball produces a function of the cam surface which reciprocates the driving portion together with the driving plate, thereby performing a pump function.

DETAILED DESCRIPTION OF THE PREFERRED EMBODIMENTS

Figure 5:
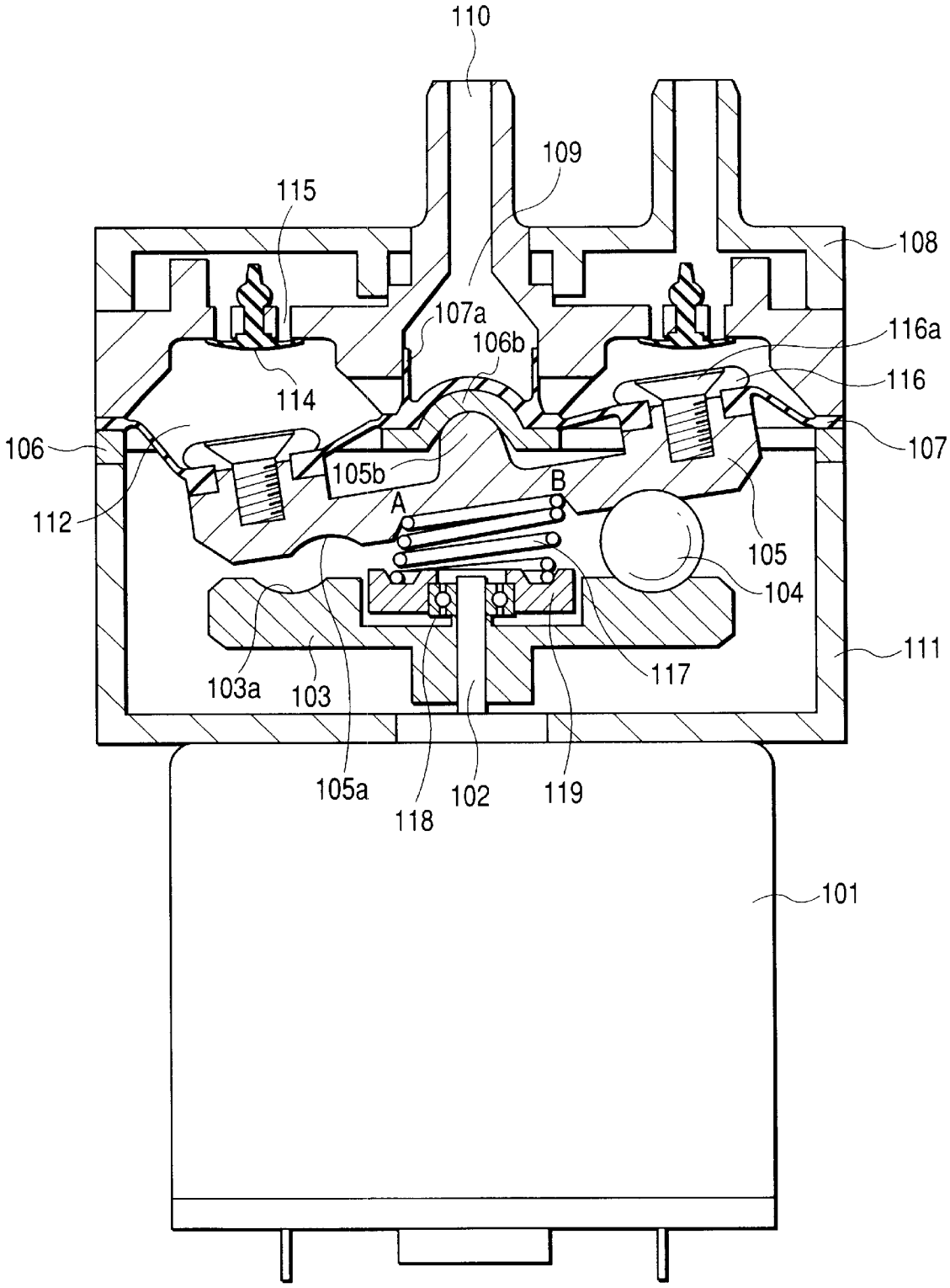
FIG. 5 is a diagram showing a configuration of a first embodiment of the miniature pump according to the present invention.

FIG. 5 is a diagram showing a first embodiment of the present invention, wherein a reference numeral 101 represents a driving motor, a reference numeral 102 designates an output shaft of the motor 101, a reference numeral 103 denotes a disk like rotating plate which is fixed to the output shaft 102 of the motor 101, a reference numeral 104 represents a ball disposed in a concave groove 103*a* which is formed in the rotating plate 103 along a circumference around the output shaft 102 of the motor and a reference numeral 105 designates a driving plate which has a concave groove 105*a* formed along a circumference at a location of a bottom surface corresponding to the concave groove 103*a* of the rotating plate 103 and a supporting shaft 105*b* at a center: the ball 104 being disposed between the concave groove 103*a* of the rotating plate 103 and the concave groove 105*a* of the driving plate 105. Furthermore, a reference numeral 106 represents a cylinder, a reference numeral 107 designates a diaphragm and a reference numeral 116 denotes a retainer: the diaphragm 107 being interposed between the driving plate 105 and the retainer 116 and fixed to the driving plate 105 with a screw 116*a*, and portions such as the retainer 116 and the screw 116*a* having a function like that of a piston. Disposed at a center portion of the cylinder 106 is a supporting bearing 106*b* which bears a supporting shaft 105*b* disposed on the driving plate 105. Furthermore, a reference numeral 108 represents a cover body, a reference numeral 109 designates a valve chamber, a reference numeral 110 denotes a discharge port, a reference numeral 111 represent a case, a reference numeral 112 designates a pump chamber, a reference numeral 114 denotes a suction valve and a reference numeral 115 represents a suction port. Though two pump chambers are shown in FIG. 5, three or more pump chambers of only one pump chamber may be used in the first embodiment. In addition, a reference numeral 107*a* represents a discharge valve which is formed integrally with the diaphragm 107 and a reference numeral 109 designates a valve chamber.

In a pump according to the first embodiment, a spring 117 is disposed between the supporting shaft 105*b* of the driving plate 105 and the rotating plate 103 located on an opposite side. In order to prevent this spring 117 from being influenced by rotations of the rotating plate 103, the pump according to the first embodiment is configured to use a spring bearing 119 which is attached to the output shaft 102 by way of a ball bearing 118 so that the spring 117 is located between the spring bearing 119 and the driving plate 105.

The reciprocating pump according to the first embodiment rotates the output shaft 102 by driving the driving motor 101, thereby rotating the rotating plate 103. When the rotating plate 103 is rotated, the ball 104 moves along the concave grooves 103*a* and 105*a* around the output shaft 102. When the ball 104 moves, an inclined direction of the driving plate 105 is changed consecutively and continuously. In a condition shown in FIG. 5, for example, the ball 104 is located on a most right side and the driving plate 105 is inclined, whereby the driving plate 105 is inclined so that a right side is highest and a left side is lowest. Due to this inclination of the driving plate 105, the retainer 116 which performs the piston function is pushed in the right side pump chamber to decrease a volume of the pump chamber 112 whereas the retainer 116 which performs the piston function is pushed down in the left side pump chamber to increase a volume of the pump chamber 112.

When the ball 104 successively moves along the grooves 103*a* and 105*a* until the ball is located on the left side, the driving plate 105 is inclined in a reverse direction, whereby the retainer 116 having the piston function is lowered in the right side pump chamber 112 to increase the volume, whereas the retainer 116 having the piston function is raised in the left side pump chamber to decrease the volume.

The inclination of the driving plate 105 is changed 360° continuously around a fulcrum (supporting shaft) and the pump function is performed continuously by repeating this change.

The reciprocating pump according to the first embodiment is configured to use the spring 117 disposed between the driving plate 105 and the spring bearing 119 so that the spring 117 pushes up the driving plate 105 in the vicinity of the supporting shaft 105*b* formed at the center of the driving plate 105. Owing to a raising force of the spring 117 which pushes up the driving plate 105 in the vicinity of the driving plate 105, exerted to a contact portion between the ball 104 and the groove 105*a* is a force which pushes down the ball while the supporting shaft 105*b* is depressed to the supporting shaft bearing 106*b*. That is, an upward force of the spring 117 in the vicinity of the supporting shaft 105*b* functions to bring the supporting shaft 105*b* into close contact with the supporting shaft bearing 106*b*, and since the ball 104 inclines the driving plate 105 (the driving plate is higher on a side of the ball 104), the spring is set in a condition where the spring is elongated on a side B of the ball as shown in FIG. 5, whereby un upward force of the spring on a side A opposite to the ball 104 is stronger than an upward force of the spring on the side B of the ball 104, thereby exerting a force of the driving plate 105 which presses the ball 104. Accordingly, the spring 117 functions to return the inclined driving plate 105 to a horizontal position.

The reciprocating pump according to the first embodiment of the present invention utilizes the force of the spring 117 to return the inclination of the driving plate 105 caused by the ball 104, thereby keeping the driving plate 105 always in contact with the ball 104. As a result, the reciprocating pump changes an inclined direction of the driving plate 105 continuously at a constant speed and allows the rotations of the rotating plate 103 to cause a secure movement of the ball 104 without slipping, thereby being capable of performing a pump function continuously while producing constant phase difference (time difference) between the pump chambers.

Furthermore, since the force which is applied from the spring 117 to the driving plate functions to reduce an inclination angle of the driving plate, the miniature pump according to the first embodiment is free from a fear that even a portion (portion which is brought closest to the rotating plate 103) of the driving plate 105 may be brought into contact with the rotating plate 103, thereby being capable of favorably driving the driving plate 105 and performing a favorable pump function. Since the force of the spring 117 is sufficient so far as the force is not weaker than a certain definite level, the spring poses no problem even when the force of the spring is more or less weakened or even when the spring is used for a long time.

Figure 6:
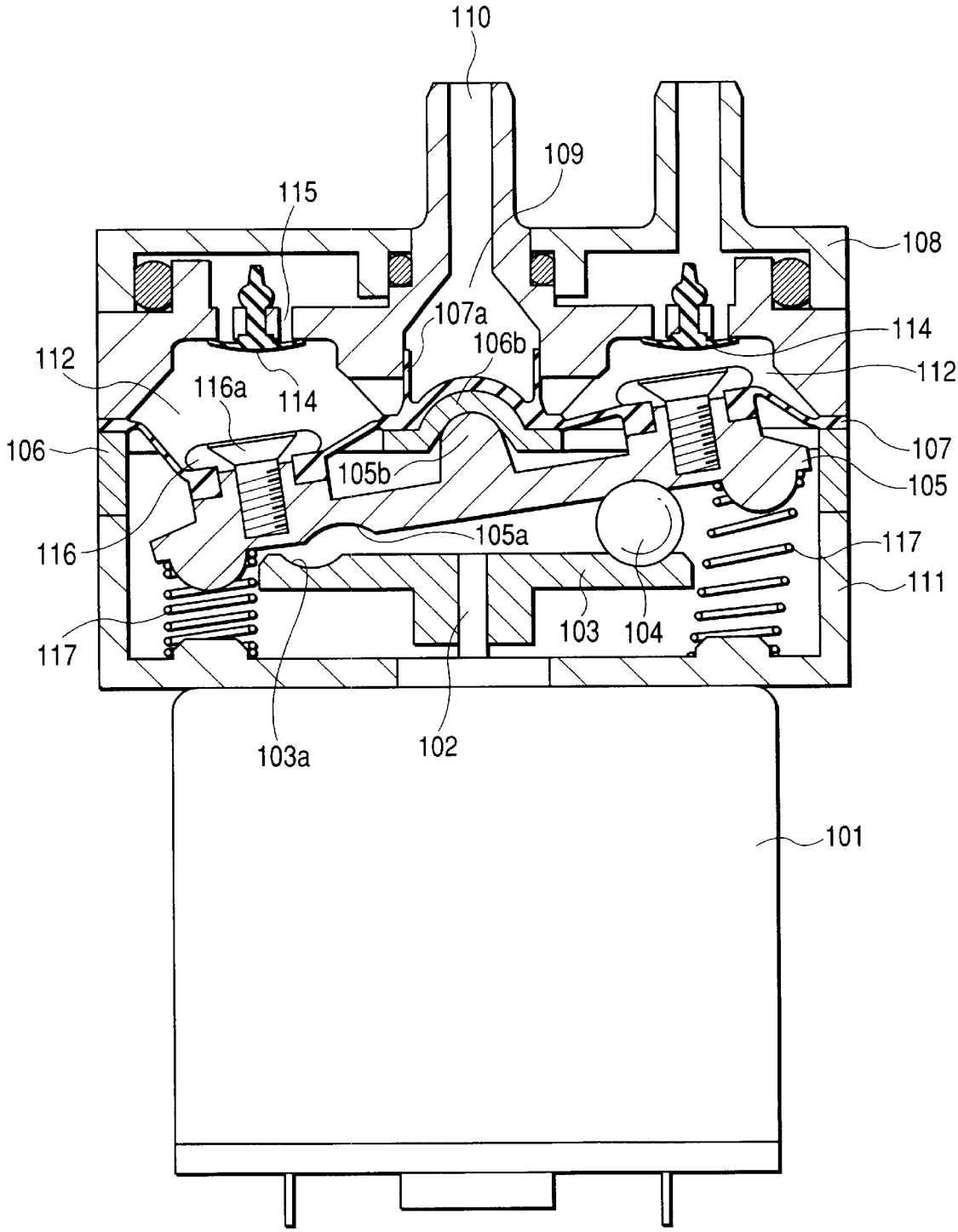
FIG. 6 is a diagram showing a configuration of a second embodiment of the miniature pump according to the present invention.

FIG. 6 is a diagram showing a reciprocating pump according to a second embodiment of the present invention.

In FIG. 6, a reference numeral 101 represents a driving motor, a reference numeral 102 designates an output shaft of the motor 101, a reference numeral 103 denotes a rotating plate which has a concave groove 103*a*, a reference numeral 104 represents a ball, a reference numeral 105 designates a driving plate which has a concave groove 105*a*, a reference numeral 106 denotes a cylinder, a reference numeral 107 represents a diaphragm, a reference numeral 110 designates a discharge port, a reference numeral 111 denotes a case, a reference numeral 112 represents a pump chamber, a reference numeral 114 designates a suction valve, a reference numeral 115 denotes a suction port and a reference numeral 116 represents a retainer; these members being substantially the same as those of the first embodiment shown in FIG. 5.

A reference numeral 117 represents a spring which is disposed between the case and the driving plate 105 so as to be located outside the rotating plate 103 utilizing a space at a lower end of the case.

The pump according to the second embodiment is different in a location of the spring 117 from the pump according to the first embodiment as described above.

The reciprocating pump according to the second embodiment drives the driving motor 101 to rotate the output shaft 102, thereby rotating the rotating plate 103. When the rotating plate 103 is rotated, the ball 104 which is disposed between the rotating plate 103 and the driving plate 105 moves along the concave grooves 103*a* and 105*a* while rotating, and when the movement of the ball 104 causes a consecutive and continuous change of an inclined direction of the driving plate 105. Accordingly, a retainer 116 which is attached to the driving plate 105 and functions like a piston moves up and down (reciprocates), thereby performing a pump function.

The pump according to the second embodiment performs the pump function which is similar to that of the pump according to the first embodiment.

Different from the first embodiment, however, the second embodiment uses the spring 117 which is disposed in an internal space of the case which is under a circumferential portion of the driving plate 105 and outside the rotating plate 103.

Since the second embodiment is configured to dispose the spring in the space of a circumferential portion of the case as described above, the second embodiment facilitates to dispose the spring and does not require configuring the spring so as to have a portion having a special structure unlike the first embodiment, that is, disposing the spring which is attached to the output shaft 102 by way of the ball bearing 118, thereby simplifying a configuration of the pump and providing a merit from a view point of a cost.

Furthermore, the spring which is disposed under a circumferential portion of the driving plate is capable of maintaining a condition where the ball 104 is secure contact with the driving plate 105 even when the spring has a relatively weak force.

In the second embodiment, a raising force of a left side spring which pushes up the circumferential portion of the driving plate 105 functions to push up a supporting shaft 105*b* at the center portion of the driving plate 105 and to be brought into close contact with a supporting bearing 106*b* and to bring the driving plate 105 into close contact with the ball 104 using the supporting shaft 105*b* as a fulcrum. Since a distance as measured from the left side spring to the supporting shaft functioning as the fulcrum is long, a weak force of the spring functions as a strong force of the driving plate which presses the ball 104. Specifically, the ball 104 is moved securely by a force of the driving plate 105 pushing the ball 104 which is produced as a difference between a pushing down force exerted to the ball 104 by pushing up the driving plate 105 with a compressed spring (the left side spring in FIG. 6) and a force of a relatively elongated spring (a right side spring in FIG. 6) pushing up the driving plate 105.

Figure 1:
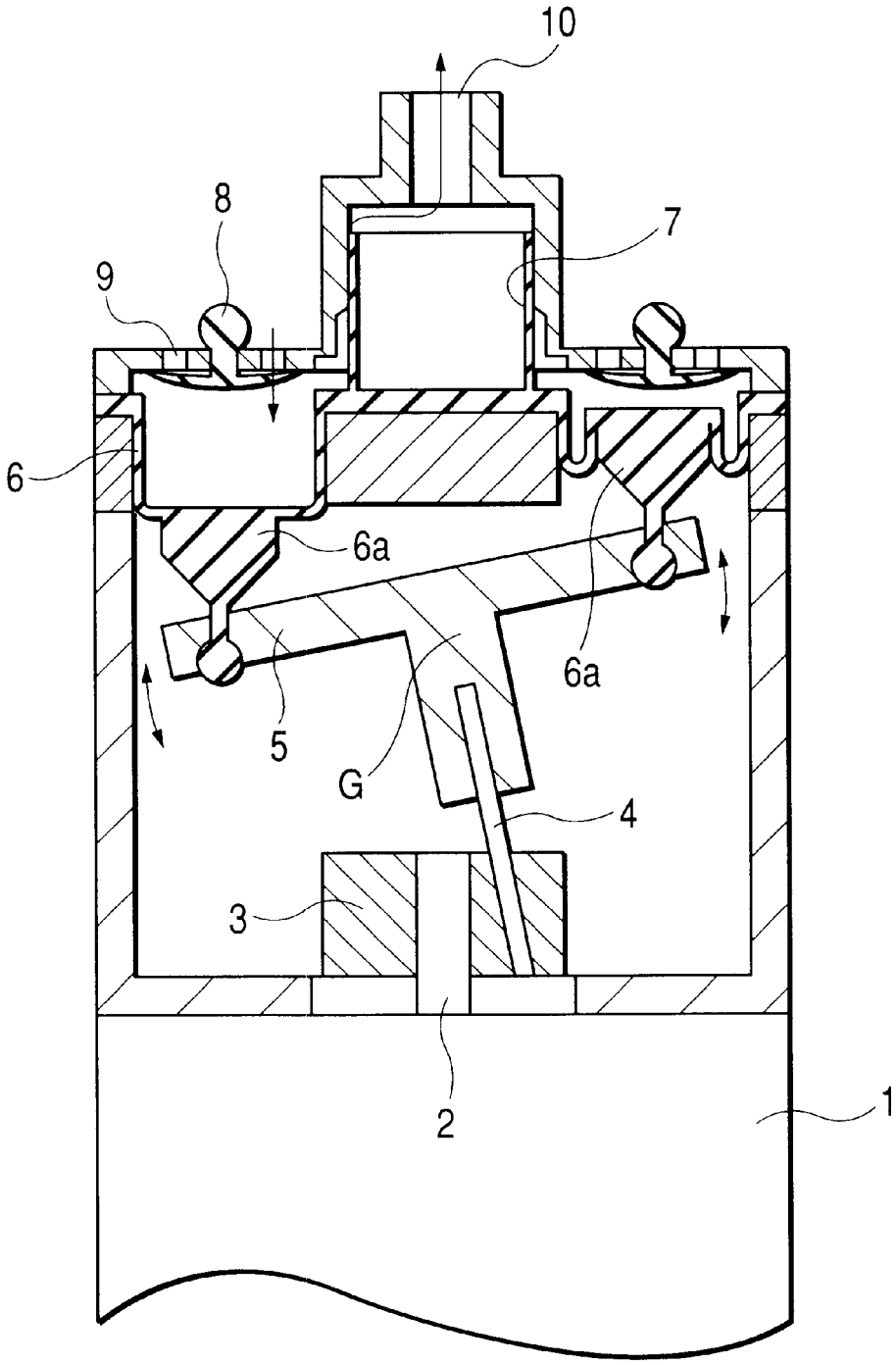
FIG. 1 PRIOR ART
FIGS. 1 through 4 are diagrams showing configuration of prior art conventional miniature pumps.
Figure 2:
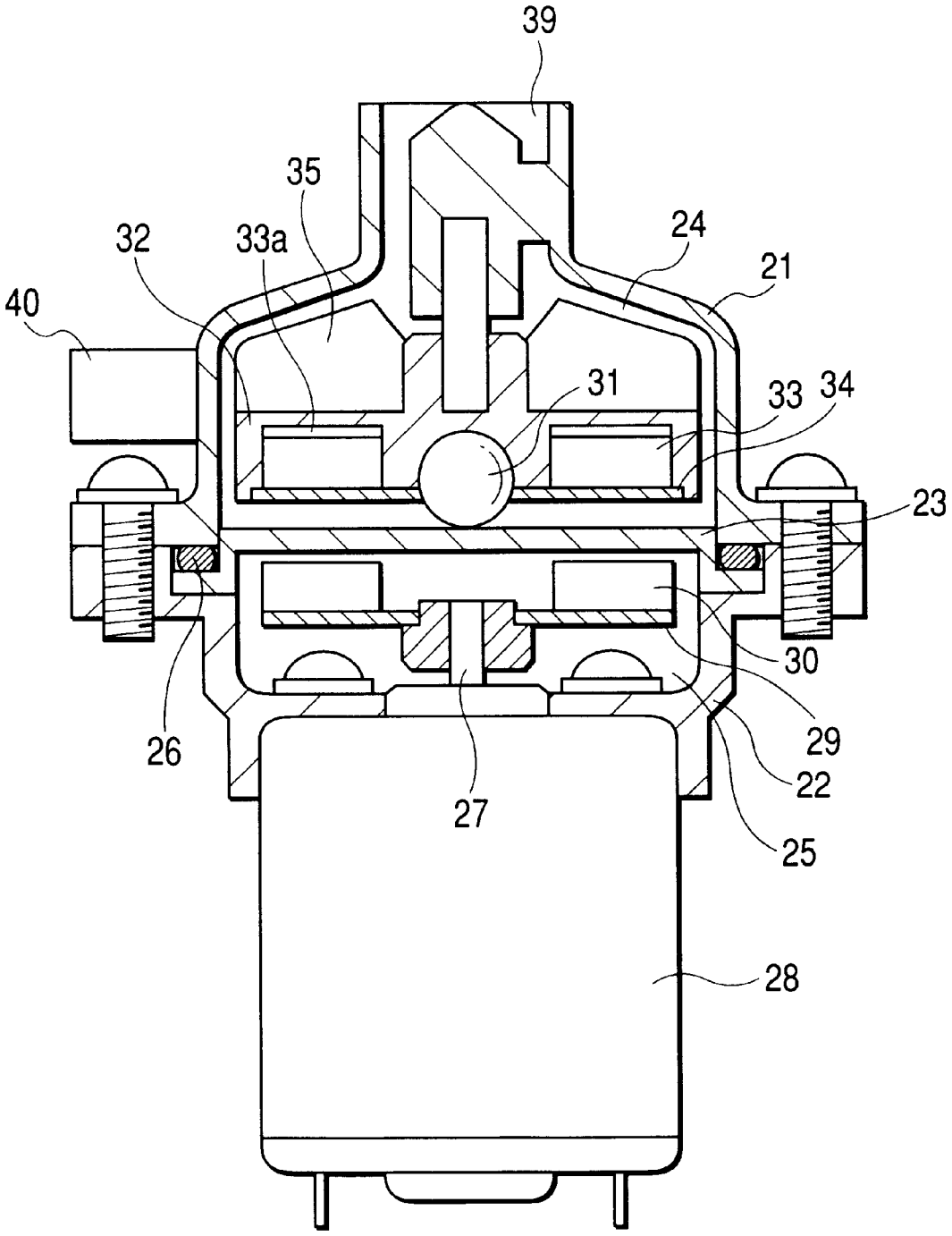
FIG. 2 PRIOR ART
Figure 3:
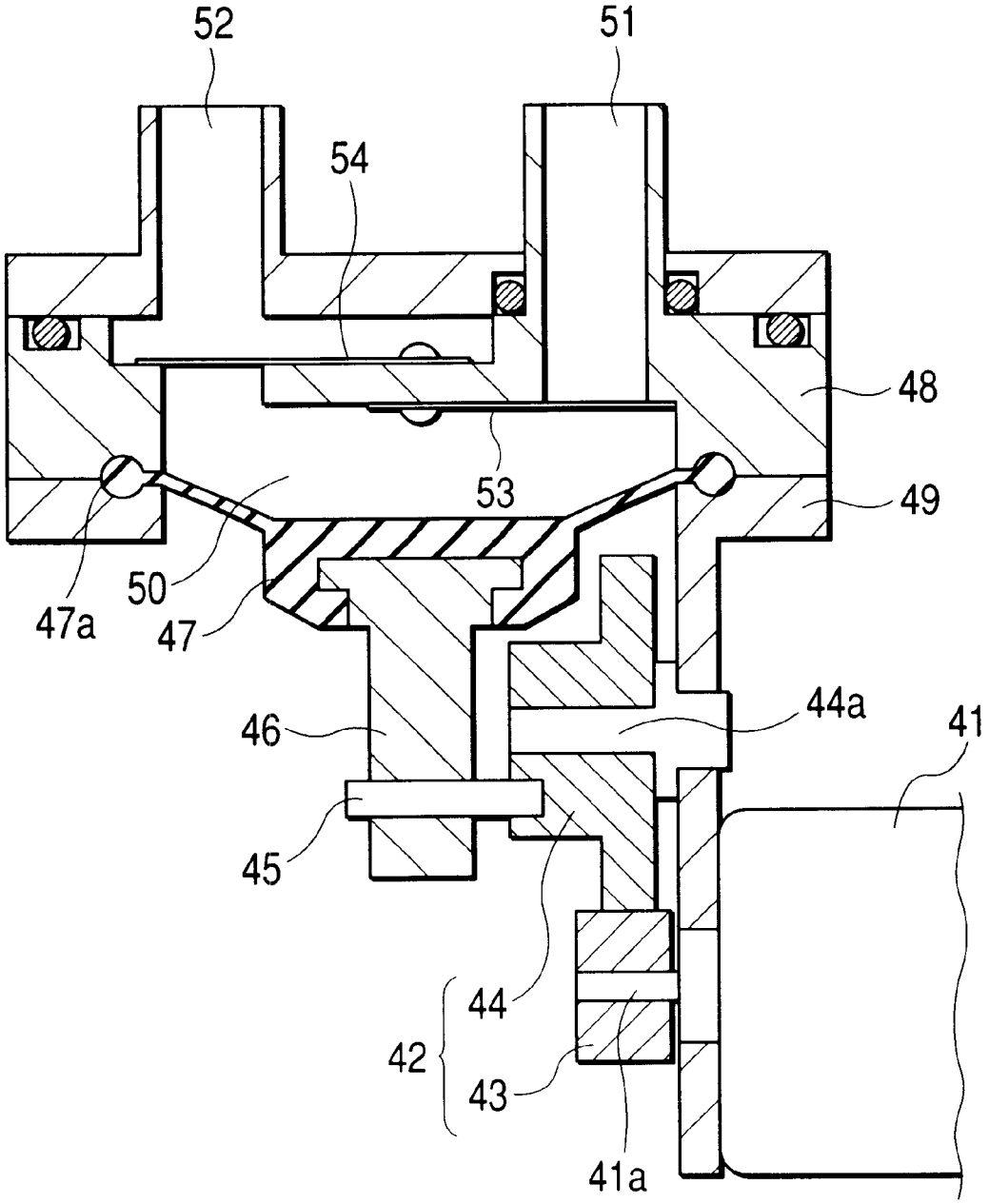
FIG. 3 PRIOR ART
Figure 4:
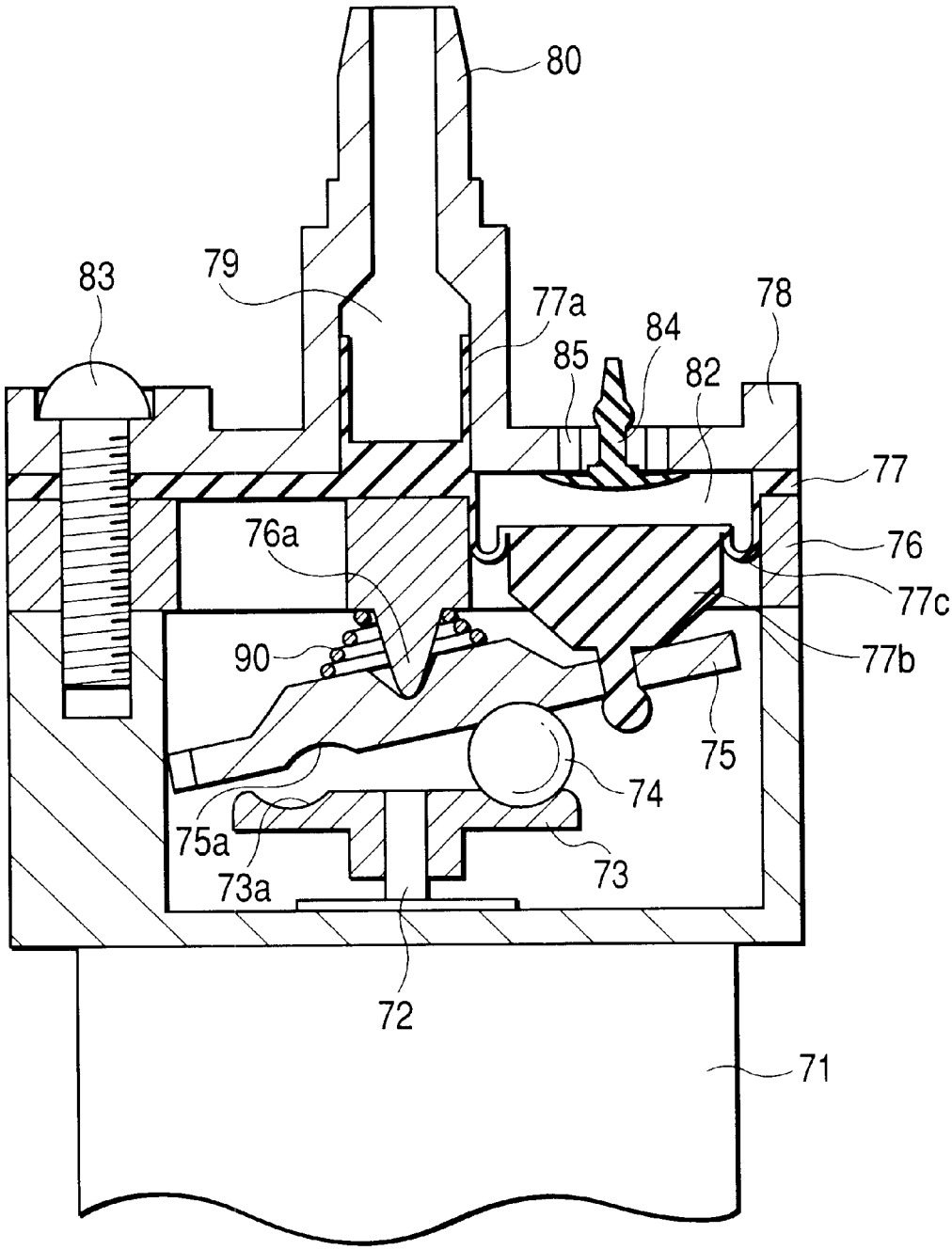
FIG. 4 PRIOR ART

Furthermore, the first and second embodiments are characterized in that configurations of diaphragms and the like which compose the pump chamber are different from those of the conventional reciprocating pump shown in FIG. 4.

That is, a pump chamber according to each of these embodiments has a shape of a nearly truncated cone (a sectional shape of a nearly trapezoid) and is retained at a circumferential portion of the driving plate 105 with the retainer 116, and a diaphragm 107 is attached to the driving plate 105 by fixing the retainer 116 to the driving plate 105 with a screw 116*a*.

Figure 7:
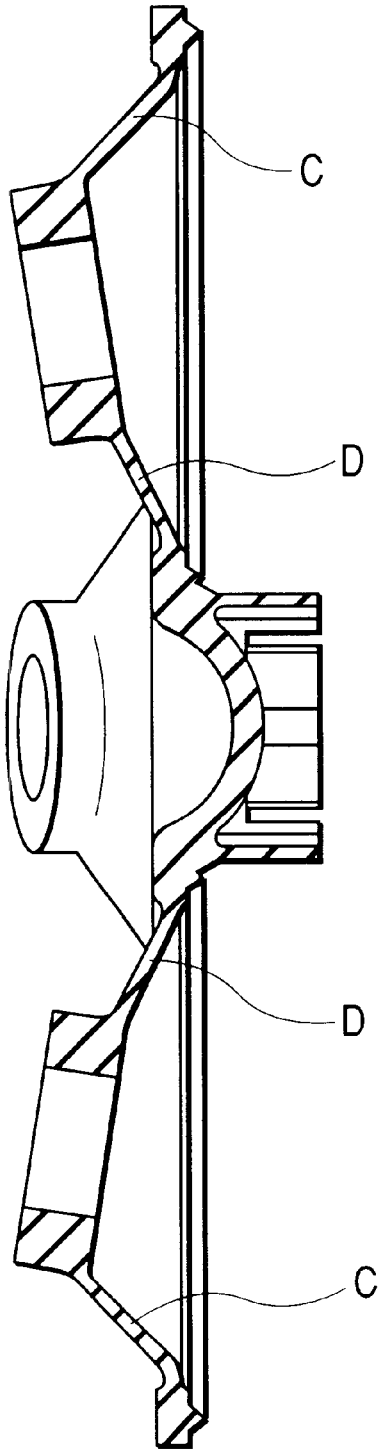
FIG. 7 is a diagram showing a form of a diaphragm to be used in the first and second embodiments.

This diaphragm is configured as shown in FIG. 7 and fixed by sandwiching the diaphragm between a cylinder 106 and a cover body 108 as shown in FIG. 5 or FIG. 6. Furthermore, the diaphragm is fixed by screwing the retainer 116 to the driving plate as described above. FIG. 7 shows the diaphragm in a condition where the diaphragm is rotated 90° from a position shown in FIG. 5 or FIG. 6.

A portion C and a portion D of this diaphragm shown in FIG. 7 have linear sectional shapes, the portion C being inclined steeply and the portion D being inclined gently.

Since the diaphragm has a linear sectional shape as described above which changes little as shown in FIG. 5 or FIG. 6, the diaphragm has a long durability. In case of a diaphragm shown in FIG. 4 which is integrated with a driving portion, the diaphragm is attached to the driving plate by pressing a fitting portion formed on the driving member into a fitting hole formed in the driving plate. The diaphragm which is configured as described above poses a problem that portions of the fitting portion of the driving member and the driving plate (a portion of the fitting hole of the driving plate) which brought into contact with each other are abraded due to rubbing and the like.

However, the reciprocating pump according to the present invention which is configured as shown in FIG. 5 or FIG. 6 is completely free from the problems posed by the conventional example.

Each of the reciprocating pumps (miniature pumps) according to the first and second embodiments of the present invention is configured to dispose the spring under the driving body which performs the pump function by changing the volume of the pump chamber so that the driving member always presses the ball, thereby moving the ball at a nearly constant speed and being capable of performing a favorable pump function. Furthermore, the diaphragm has the nearly linear sectional shape and a prolonged service life.

Figure 8:
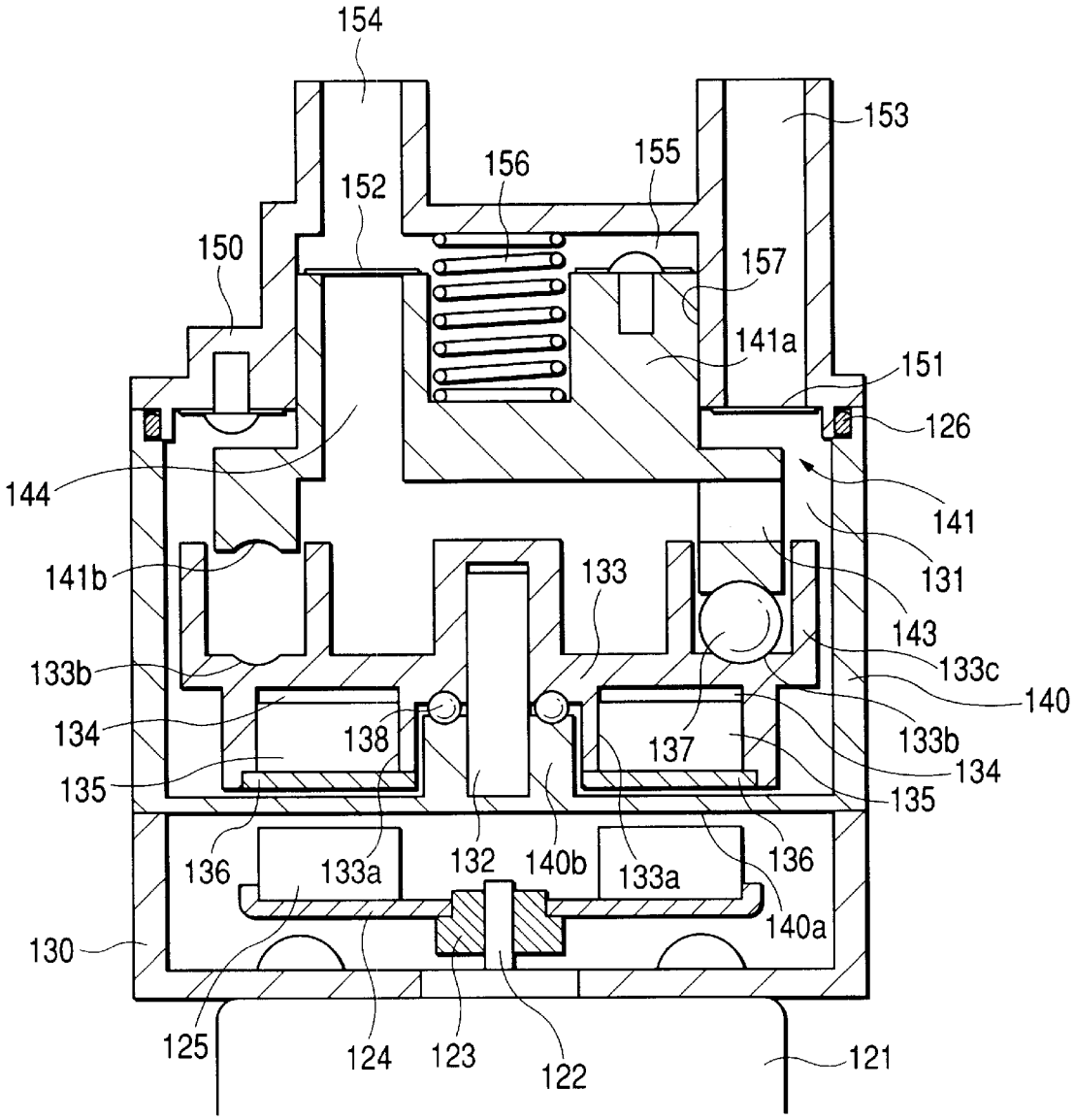
FIG. 8 is a diagram showing a configuration of a third embodiment of the miniature pump according to the present invention.

FIG. 8 shows a pump according to a third embodiment, wherein a reference numeral 121 represents a driving motor, a reference numeral 122 designates an output shaft of the motor 121, a reference numeral 123 denotes a bush which is fixed to the output shaft 122, a reference numeral 125 represents a driving magnet which is fixed to a driving yoke 124 attached to the bush 123 by means such as caulking: these members being accommodated in a first case 130. A reference numeral 140 represents a second case and a reference numeral 150 designates a third case (cylinder case), a sealed chamber 131 is formed by coupling these second and third cases airtightly by way of an O ring 126, and the second case 140 is fixed to the first case 130, whereby the first, second and third cases are combined so as to compose an outside frame of the pump. Formed at a central portion of the second case 140 in the sealed chamber 131 is a boss portion **140*b* to which a shaft 132 is pressed and fixed. A reference numeral 133 represents a rotating plate which is disposed rotatably around the shaft 132, a reference numeral 134 designates a yoke and a reference numeral 135 denotes a follower magnet: these yoke 134 and follower magnet 135 being embedded in a magnet holding portion 133*a* of the rotating plate 133 and hold by fixing a holding plate 136 to the rotating plate 133. The follower magnet 135 is configured to be disposed at a location opposed to the driving magnet 125. A concave groove 133*b* which has a circumferential shape (ring shape) and an arc like section is formed along an outer circumferential surface of the rotating plate 133, and ball drop preventing walls 133*c* are formed concentrically on both sides of (inside and outside) the concave groove 133*b*. A reference numeral 137 represents a ball which is disposed so as to be movable along the concave groove 133*b* which is formed in a top surface of the rotating plate 133, and has the ring shape and the arc like section. In addition, a reference numeral 138 denotes a ball bearing which is disposed so that the rotating plate 133** rotates stably and smoothly.

Furthermore, a reference numeral 141 represents a piston portion (driving body) which has an upper portion configured as a piston (driving portion) performing a pump function and a lower portion having a ring like (circumferential) concave groove **141*b* which is formed along a circumference and has an arc like section. A bottom surface as a whole of the piston portion is an inclined surface having a constant gradient. That is, the ring like surface in which the concave groove 141*b* is formed as a cam surface which is lowest (closest to the rotating plate 133) on a right side in FIG. 8 and highest (farthest from the rotating plate 133) on a left side. In addition, formed in the piston portion 141 are flow paths 143 and 144 through which a fluid is to flow. The above described ball 137 is located between the concave groove 141*b* of the piston portion 141 and the concave groove 133*b* formed in the rotating plate 133 as shown in FIG. 8. Accordingly, the piston portion 141 is moved up and down by the ball which moves along the concave grooves 133*b* and 141*b* when the rotating plate 133** is rotated.

Reference numerals 151 and 152 represent a suction valve and a discharge valve respectively, reference numerals 153 and 154 designate a suction port and a discharge port respectively formed in the third case, a reference numeral 155 denotes a pump chamber and a reference numeral 156 represents a spring.

In addition, the suction valve 151 is a ring having a circular opening at a center, a side which is fixed to the piston portion (driving portion) with a screw and the other side which opens and closes a flow path communicated with the suction port 153. The piston (driving portion) **141*a* is fitted in the circular opening. Similarly, the discharge valve 152 is also a ring having a circular opening in which the spring 156** is located.

The third embodiment of the present invention is configured to rotate the ring like driving magnet 125 together with the driving yoke 124 when the output shaft 122 is driven and rotated by the motor 121. When the driving magnet 125 is rotated, the ring like follower magnet 135 which is disposed in opposition to the driving magnet 125 with a bottom surface **140*a* of the second case 140 interposed is also rotated. When the follower magnet 135 is rotated, the rotating plate 133 is rotated, thereby moving the ball 137. This movement of the ball 137 causes a change of a position (vertical position in FIG. 8) of the cam surface 141*a* which is in contact with the ball 137, whereby the piston member 141 reciprocates along a straight line in a vertical direction in FIG. 8 along the cylinder portion 157. That is, the piston portion 141 makes nearly a reciprocal movement when the ball 137 moves about 360°. Since the piston portion (driving body) 141 is always pressed by the spring 156, the concave groove 141*b* which is the cam surface of the piston portion 141 is in close contact with the ball 137 and the ball 137 is in close contact with the concave groove 133*b* of the rotating plate 133. The ball 137 therefore turns (rotates) and moves (revolves) while being kept in close contact with the concave groove 133*b* and the concave groove 141*b* when the rotating plate 133 is rotated. Accordingly, the piston portion 141** moves up and down as described above.

Figure 9:
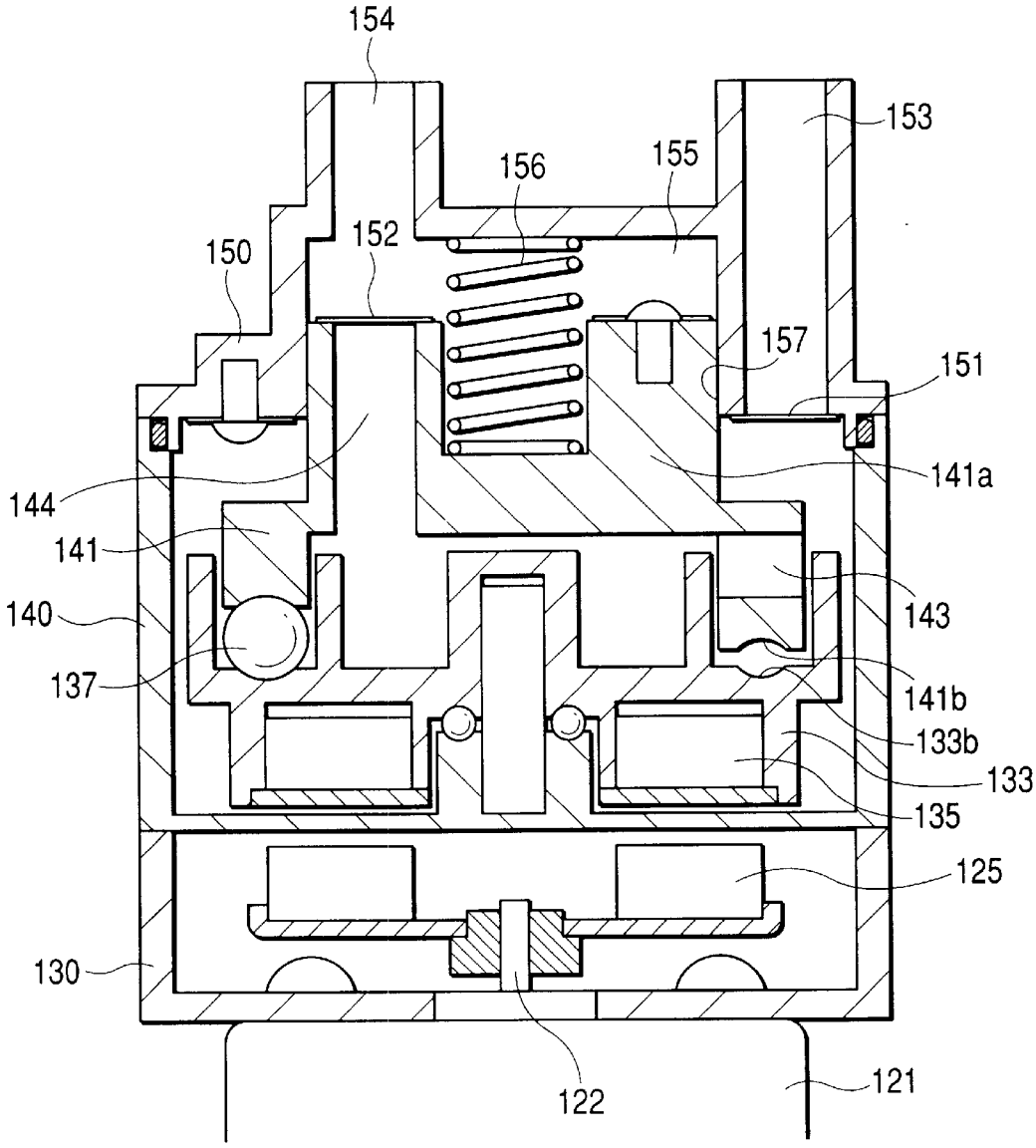
FIG. 9 is a diagram showing a condition where a ball has traveled 180° in the miniature pump shown in FIG. 8.
Figure 10:
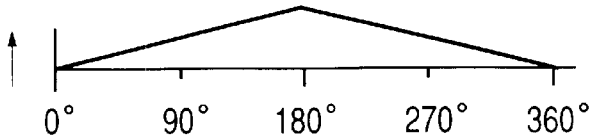
FIG. 10 is a diagram showing a relation between rotations of a rotating plate and a movement of a driving portion.

FIG. 10 shows the movement of the piston portion which starts from a left side (position shown in FIG. 8) is positioned highest (position shown in FIG. 9) when the ball moves 180° and lowest when the ball further moves 180°, that is, when the ball moves from 0° to 360°. That is, the piston portion returns to the position shown in FIG. 8.

In FIG. 10, a horizontal direction represents a movement amount of the ball expressed in terms of an angle and a vertical direction designates a movement of the piston portion corresponding to the movement of the ball.

During the reciprocal movement of the piston portion 141, the piston portion 141 is lowered until the ball 137 moves 180° and is set in a condition shown in FIG. 9 as described above, whereby a volume of the pump chamber 155 is increased, a pressure is lowered and the discharge valve 152 opens. On the other hand, a volume of the sealed chamber 131 in the second case 150 is decreased and a pressure is enhanced, whereby the suction valve 151 is closed. While the ball 137 further moves 180° and returns to a condition shown in FIG. 8, the piston portion 141 is gradually enhanced, the discharge valve 152 is closed, and a fluid in the pump chamber is discharged through the discharge port 154 and supplied to a desired location. Furthermore, a volume of the sealed chamber 131 is increased and the pressure is lowered. Accordingly, the suction valve 151 opens, and the fluid flows through the suction port 153 and fills the sealed chamber 131, the flow paths 143, 144 and the like.

When the piston portion 141 is further enhanced, the fluid flows out of the pump chamber 155 through the discharge port 154. The pump function is performed by repeating these operations.

The pump according to the third embodiment is configured to rotate and revolve the ball, thereby moving about 180° along the concave grooves 133*b* and 141*b* while the rotating plate 133 makes a turn, and further move the ball about 180° or about 360° while the rotating plate further makes a turn, that is, two turns from start.

The piston portion makes advance or retreat of one turn around the cylinder as the ball moves about 180° and the piston portion makes retreat or advance as the ball moves about 360°.

The third embodiment of the present invention is configured to allow the piston member 141 to make about a reciprocal movement while the rotating plate 133 makes about two turns as described above. Since the cam surface (concave groove) 141*b* of the piston portion is inclined, the cam surface 141*b* is actually longer than the concave groove 133*b* of the rotating plate 133 and a length of the cam surface 141*b* is different dependently of an inclination angle. That is, the pump according to the third embodiment has a speed which is reduced from a rotating frequency of the rotating plate at a ratio of 1:2.2 to 1:2.3.

The miniature pump according to the third embodiment of the present invention is configured to move up and down (reciprocate) the driving body composed of the piston portion 141 by the movement of the ball 137 caused by the rotation of the rotating plate 133 owing to a function of the cam surface which is formed in a bottom surface of the driving body composed of the piston portion 141 and has the constant gradient, whereby the pump function is performed by the reciprocal movement of the piston portion (driving body) 141*a* of the piston portion (driving body) 141 as described above. Since the pump according to the third embodiment of the present invention is a pump which uses a piston as described above, the pump is capable of obtaining a sufficient pressure even when the pump is used as a liquid pump. Furthermore, the pump can be configured compact since a driving mechanism for driving the piston consists of a combination of the rotating plate, the cam surface and the ball.

Furthermore, since the driving mechanism consisting of the rotating plate, the cam surface and the ball reciprocates the piston in a condition where a speed of the driving mechanism is reduced from the rotation of the rotating plate as described above, the pump is capable of reducing a speed without using a special speed reduction mechanism such as a reduction gear and being driven with a miniature motor. The third embodiment is therefore preferable for configuring a pump more compact and reducing a cost.

Though the cam surface having the gradient is formed on the bottom surface of the driving body in the third embodiment, it is possible to obtain a miniature pump which performs quite a similar pump function by forming a cam surface having a gradient on a surface of the rotating plate on a side of the driving body without sloping the bottom surface of the driving body. That is, it is possible to configure the concave groove 133*b* of the rotating plate 133 so as to have a constant gradient without sloping the concave groove 141*b* of the piston member 141.

Figure 11:
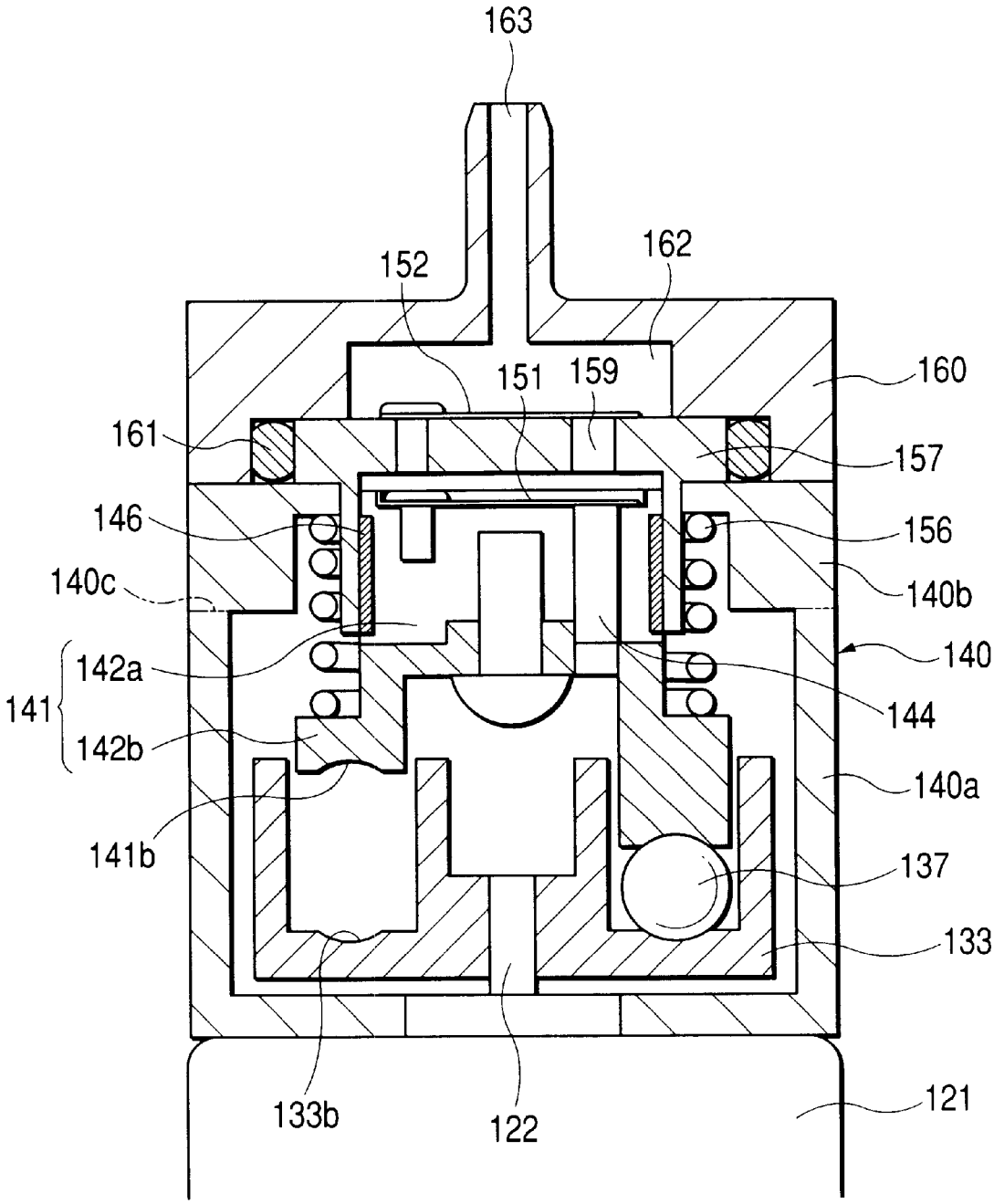
FIG. 11 is a diagram showing a configuration of a fourth embodiment of the miniature pump according to the present invention.

FIG. 11 is a diagram showing a fourth embodiment of the present invention. Unlike the pump according to the third embodiment, a pump according to the fourth embodiment is configured to drive a rotating plate 133 directly with a motor 121 and the rotating plate 133 is fixed to an output shaft 122 of the motor 121.

That is, a reference numeral 121 represents the motor, a reference numeral 122 designates the output shaft, a reference numeral 133 denotes the rotating plate, a reference numeral 137 represents a ball, a reference numeral 141 designates a piston portion (driving body) and a reference numeral 157 denotes a cylinder portion in FIG. 11.

In the fourth embodiment, a piston (driving portion) 142*a* and a cam portion 142*b* are configured separately, and these portions are fixed and integrated with a screw or the like so as to compose a piston portion (driving body). Furthermore, a piston ring 146 made of a material having a high sliding property is embedded in the cylinder portion 157 so that airtightness is maintained between the cylinder portion 157 and the piston portion 141 and the piston portion 141 can reciprocate smoothly. Furthermore, a flow path 144 is formed in the piston portion 141, a flow path 159 is similarly formed also in the cylinder portion 157, and valves 151 and 152 are disposed in these flow paths respectively.

Furthermore, a reference numeral 160 represents a fourth case (cover body), a second case 140 is kept airtight using an O ring 161 and a pump chamber 162 is formed in the fourth case 160. A discharge port 163 is formed in the fourth case 160. In addition, a suction port (not shown) is formed in the second case 140.

The pump according to the fourth embodiment drives the motor 121 to rotate the output shaft 122, thereby directly rotate the rotating plate 133 and moving the ball 137 along a concave groove 133*b* formed in the rotating plate 133. This movement of the ball causes upward and downward movements of the piston portion 141 as in the third embodiment. A pump function is performed by the upward and downward movements, that is, reciprocal movements of the piston portion 141.

That is, the piston portion 141 is lowered when the ball 137 moves 180° from a condition shown in FIG. 11 to an opposite side. When the piston portion 141 is lowered, a fluid flows into the pump from an inlet port through the flow path 144, thereby opening the valve 151.

When the ball 137 further moves 180° successively and returns to a position shown in FIG. 11, the piston portion 141 is raised, whereby the fluid passes through the flow path 159, opens the valve 152 and flows out through the discharge port 163.

The pump according to the fourth embodiment shown in FIG. 11 has a structure which makes it relatively difficult to manufacture the case 140. For manufacturing the case 140 easily, it is preferable to manufacture two parts corresponding to a part 140*a* and a part 140*b* which are obtained by dividing the case 140 along a plane indicated by a two-point chain line 140*c* shown in FIG. 11, and join these two parts into the integral case 140.

Figure 12:
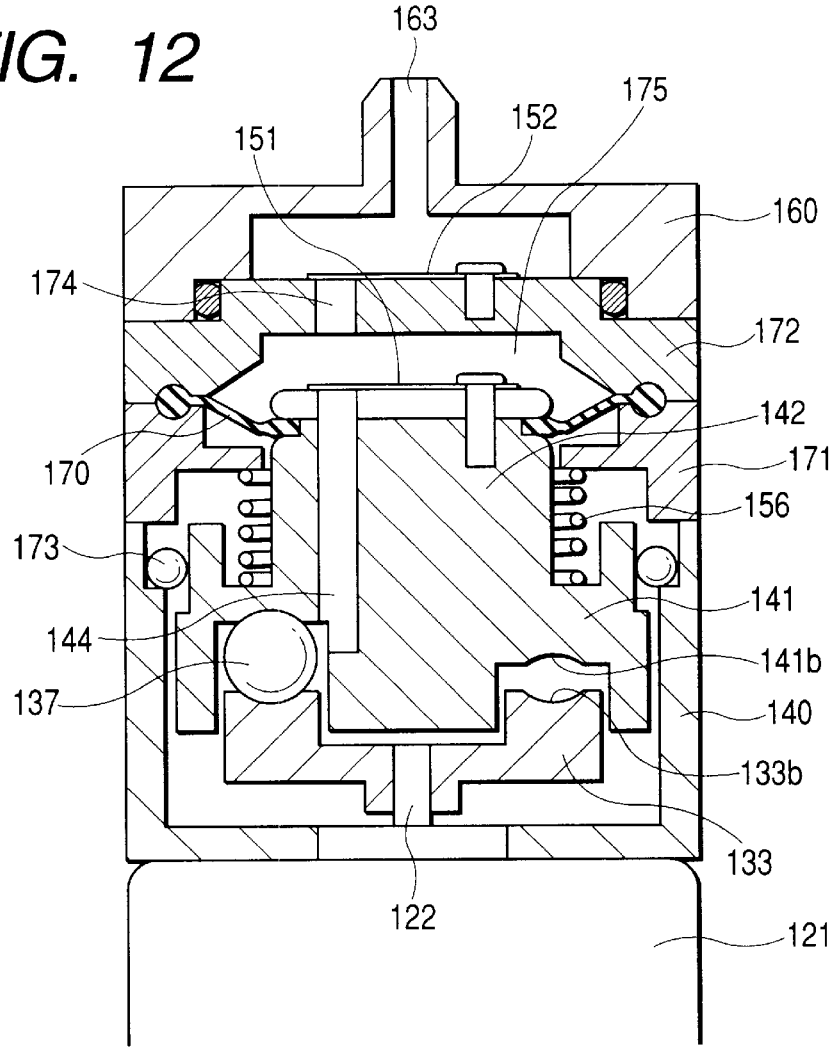
FIG. 12 is a diagram showing a configuration of a fifth embodiment of the miniature pump according to the present invention.
Figure 13:
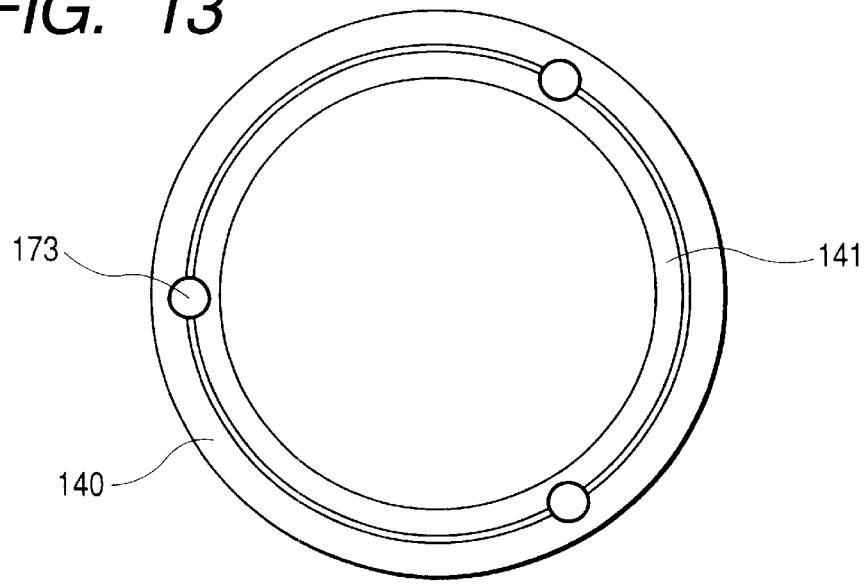
FIG. 13 is a plan view of a case of the pump shown in FIG. 12.

FIGS. 12 and 13 show a fifth embodiment of the miniature pump according to the present invention. The fifth embodiment is an example wherein a diaphragm pump is used as a pump, FIG. 12 is a sectional view and FIG. 13 is a partial plan view showing a fourth case.

In FIGS. 12 and 13, a reference numeral 121 represents a motor which is attached to a second case 140, a reference numeral 122 designates an output shaft of the motor 121, a reference numeral 133 denotes a rotating plate having a concave groove 133*b* which has an arc like sectional shape and is formed in a ring like shape, reference numeral 137 represents a ball, a reference numeral 141 designates a driving body which has a concave groove 141*b* having a shape similar to that of the concave groove 133*b* formed in the rotating plate 133 and located so as to oppose to the concave groove 133*b*, and a driving portion 142 corresponding to the piston (driving portion) in the third embodiment. Furthermore, a surface which has the concave groove 141*b* of a bottom surface of the driving body 141 is configured as an inclined surface having a constant gradient which composes a cam surface. Furthermore, formed in this driving body 141 is a flow path 144 which is communicated with an inlet port (not shown) disposed in the case 140 and a valve 151 is attached to a tip portion of the flow path 144. A reference numeral 170 represents a diaphragm which is attached to a tip portion of the driving portion 142 of the driving body 141 and a circumferential portion of this diaphragm which is the other end is sandwiched between cases 171 and 172. A reference numeral 173 designates a ball serving as a detente and a steady rest which prevent the driving body 141 from being rotated relative to a second case and the like and allow the driving body 141 to move smoothly downward in FIG. 12. This ball 173 is disposed, for example, at three locations as shown in FIG. 13, but the three locations are not limitative. Formed in the case 172 is a flow path 174 and a valve 152 is attached to a tip of the flow path 174. Furthermore, a reference numeral 156 denotes a spring which is disposed between the driving body 141 and the case 171 for pressing the driving body 141 downward so that the driving body 141 is always in pressure contact with the ball 173, and a reference numeral 160 designates a fourth case (cover body) which has a discharge port 163 and forms a pump chamber 162.

The miniature pump according to the fifth embodiment drives the motor 121 to rotate the output shaft 122, thereby rotating the rotating plate 133. When the rotating plate 133 is rotated, the ball 137 rotates and revolves, thereby moving between the concave groove 133*b* of the rotating plate 133 and the concave groove 141*b* (groove in the cam surface) of the driving body 141. When the ball 137 moves, the driving body 141 moves up and down, and the driving portion 142 also moves up and down, thereby increasing and decreasing a volume of the pump chamber composed of the diaphragm, and the like, and performing a pump function. That is, the volume of the pump chamber 175 is increased as the driving body is lowered, the valve 151 is opened and a fluid flows into the pump chamber 175 through the flow path 144. Furthermore, when the volume of the pump chamber 175 is decreased, that is, when a pressure is enhanced as the driving body 141 is raised, the valve 151 is closed and the valve 152 is opened, whereby the fluid is discharged from the discharge port 163 disposed in the fourth case (cover body) 160. The pump function is performed by repeating these operations.

The fifth embodiment uses the diaphragm and performs the pump function with the driving portion which reciprocates along a straight line, thereby being free from unnatural deformation of the diaphragm and preferable from a viewpoint of a durability.

The miniature pump according to the fourth and fifth embodiments described above are also configured to have gradients at portions of the concave grooves which are formed in the ring shapes as the cam surfaces in the vicinities of the bottom surfaces of the driving bodies (piston portions), that is, the surfaces on the sides of the rotating plates and perform the pump functions by moving up and down the driving bodies. However, it is possible to configure the bottom surface of the driving body as a horizontal surface and form a constant gradient the ring like portion in which is concave groove of the rotating plate is formed, whereby the driving body is moved up and down by up and down movements of the ball caused when the ball moves.

Furthermore, it is desirable to dispose a rotation stop mechanism (the ball or the like shown in FIGS. 12 and 13) in the pump according to the third embodiment or the fourth embodiment though such a mechanism is not shown in FIG. 8 or FIG. 11 showing the pump according to the third or fourth embodiment.

Each of the pumps according to the third through fifth embodiments of the present invention is configured to reciprocate the driving body having the driving portion such as a piston with a combination of the ball and the cam surface, whereby a speed of the pump can be slowed down without using a speed reduction mechanism and the pump can be operated with a small motor. Furthermore, the pump is capable of obtaining a pressure sufficient for use as a liquid pump when a piston is used as a driving member.

What is claimed is:

1. A miniature pump comprising: a pump chamber which is communicated with a suction port by way of a check valve and communicated with a discharge port by way of another check valve; a driving portion which performs a pump function by increasing and decreasing a volume of said pump chamber; a driving plate to which said driving portion is attached and which reciprocates said driving portion; a rotating plate which is fixed to an output shaft of a motor; a ball disposed at a location which is between said driving plate and said rotating plate, and apart from said output shaft; and means for applying a force to a surface of said driving plate on a side of said rotating plate for bringing said driving plate into close contact with said ball, wherein an inclined direction of said driving plate is continuously changed by a movement caused due to rotations and revolutions of said ball as said rotating plate rotates, thereby reciprocating said driving portion and performing a pump function.

2. The miniature pump according to claim 1, wherein said means for applying the force to said driving plate is a spring which is disposed between said driving plate and said rotating plate and in the vicinity of a rotating shaft.

3. The miniature pump according to claim 2, wherein said pump comprises a spring bearing which is disposed in the vicinity of said output shaft and kept fixed during rotations of said rotating plate, and said spring is disposed between said driving plate and said spring bearing.

4. The miniature pump according to claim 3, wherein said spring bearing is held by said output shaft by way of a ball bearing.

5. The miniature pump according to claim 1, wherein said means for applying the force to said driving means is a plurality of springs which are located around said driving plate and outside an outer circumference of said rotating plate.

6. A miniature pump comprising: a pump chamber which is communicated with a suction port by way of a check valve and communicated with a discharge port by way of another check valve; a driving portion which performs a pump function by increasing and decreasing a volume of said pump; a driving plate which reciprocates said driving portion; a rotating plate which is fixed to an output shaft of a motor; and a ball which is disposed between said driving plate and said rotating plate, wherein a cam surface is formed on said driving plate on a side of said rotating plate, and rotations of said rotating plate causes rotations and revolutions of said ball so as to cause a movement of the ball, which produces a function of the cam surface for reciprocating said driving portion together with said driving plate, thereby performing a pump function.

7. The miniature pump according to claim 6, wherein said pump comprises a cylinder which composes said pump chamber and a piston which composes said driving member.

8. The miniature pump according to claim 6, wherein said pump comprises a diaphragm which composes said pump chamber and said driving portion is integrated with said diaphragm.

9. The miniature pump according to claim 6, 7 or 8, wherein said pump comprises a driving magnet which is fixed to said output shaft, and a follower magnet which is disposed in opposition to said driving magnet and fixed to said rotating plate, and wherein said motor drives the output shaft so as to rotate the driving magnet and the rotations of said driving magnet causes rotations of said follower magnet due to magnetic coupling, thereby rotating said rotating plate and performing a pump function.

* * * * *